US005179350A

United States Patent [19]

Bower et al.

[11] Patent Number: 5,179,350

[45] Date of Patent: Jan. 12, 1993

[54] DRIFT TUBE LINAC WITH DRIFT TUBE PERFORMANCE NORMALIZATION AND MAXIMIZATION

[75] Inventors: John H. Bower; James M. Potter, both of Los Alamos; Joseph P. Rymer, Livermore, all of Calif.

[73] Assignee: AccSys Technology, Inc., Pleasanton, Calif.

[21] Appl. No.: 741,141

[22] Filed: Aug. 7, 1991

[51] Int. Cl.[5] ..... H05H 9/00; H05H 7/00

[52] U.S. Cl. ..... 328/233; 328/227; 315/5.41

[58] Field of Search ..... 328/233, 227; 315/5.41, 315/5.42, 5.46, 5.47, 5.53

[56] References Cited

U.S. PATENT DOCUMENTS 4,485,346 11/1984 Swenson et al. ..... 328/233
4,596,946 6/1986 Pottier ..... 315/5.42 X
5,084,682 1/1992 Swenson et al. ..... 328/227 X

*Primary Examiner*—Donald J. Yusko
*Assistant Examiner*—Ashok Patel
*Attorney, Agent, or Firm*—Kolisch, Hartwell, Dickinson, McCormack & Heuser

[57] ABSTRACT

Apparatus for normalizing and maximizing the performance of a drift tube on the operational axis of a drift tube linac. The apparatus features drift tube positioning through structure which includes orthogonally disposed, facially complementary datum surfaces, interposed which surfaces are dimensionally stable, clamped shim structure. Also offered is independently attachable/detachable (non-dedicated in place) adjustment mechanism employable to effect adjustments in the usual post-coupler structures associated with drift tubes.

7 Claims, 5 Drawing Sheets

DRIFT TUBE LINAC WITH DRIFT TUBE PERFORMANCE NORMALIZATION AND MAXIMIZATION

BACKGROUND AND SUMMARY OF THE INVENTION

This invention pertains to a drift tube linear particle accelerator, and more particularly, to such an accelerator which is specially augmented with apparatus, provided in accordance with the present invention, that uniquely promotes easy normalization and maximization of the operational performance of a drift tube employed in the accelerator.

Drift tube linear particle accelerators, also known as linacs, are well known to those skilled in the art. Just speaking by way of general and introductory terms, such an accelerator typically includes an elongate, cylindrical housing, distributed centered on and along the central operational axis of which are plural, annular drift tubes which are typically supported in position by externally adjustable mounting structure located on the outside of the housing, which mounting structure usually permits several degrees of motion for "axial" positional adjustment of the tubes—i.e., multidirectional adjustment. The respective geometries of the tubes, and their intended relative positions along the operational axis of an accelerator, are known and readily determinable in accordance with well-known operational theory relating to the necessary and desired particle-accelerating electromagnetic field configuration which is intended to exist along the axis of the accelerator.

In current drift tube linacs, final positioning of a drift tube along the operational axis typically is performed through adjustment mechanism which includes pivot points and infinitely adjustable screws. This mechanism, however, complex and expensive, has proven to offer poor long-term stability, and, in addition, to be troublesome under certain maintenance circumstances, such as, for example, where disassembly becomes necessary at some point in time for servicing, such as for mending a radio-frequency seal or a vacuum seal, or for some other necessary procedure. Adjustment screws are notorious for shifting positions, and a consequence of this is that disassembly and reassembly normally requires a complete, subsequent, entire readjustment of the set-screw, etc., positioning mechanism in order to return the associated drift tube to its proper operational position.

Normally cooperating with each Nth drift tube in a drift tube linac, and often for each and every drift tube, is what is known as a post-coupler which includes a paddle-like blade carried on the end of an elongate wand which extends through the wall of a linac housing radially toward the circumferential side of an associated drift tube. Typically, as one progresses axially along a linac, successive post-couplers extend in alternately from diametrally opposite sides of the housing. Through rotational and translational adjustment of the position of the "paddle" relative to its associated drift tube, important field-configuration adjustments can be made. With respect to such post-coupler structure, it is conventional to provide for each such structure, on the outside of the linac housing, full-complement, always-in-place, dedicated adjustment mechanism, and, this is an expensive consideration in the overall structure of a linac.

With regard to the operations of the drift tubes, standing high on the list of matters which must be met carefully for successful performance are (1), precision in the positional relationship of each drift tube along and relative (circumferentially) to an accelerator's operational axis, and (2), field configuration manipulation through positional adjustment (translational and rotational) of any adjacent and associated post-coupler. Naturally, these considerations are well known and have been addressed in prior art drift tube accelerator structures, but the best of the known prior art solutions leave important things to be desired, which "things" are amply, simply and quite elegantly addressed by the apparatus of the present invention.

In general terms, the apparatus of the present invention is one for both normalizing and maximizing the performance of a drift tube along the operational axis of the elongate housing in a drift tube linear particle accelerator. The phrase "normalizing and maximizing" is intended to convey the important notion that the apparatus promotes a situation where each associated drift tube performs substantially exactly in accordance with what is expected of it, and in a manner which maximizes its contribution to the particle-accelerating field in an accelerator.

As will become quite fully apparent from the drawings and description to be encountered in what follows, a preferred embodiment of the apparatus of the invention contemplates, for each drift tube in an accelerator, what is referred to as a datum unit which is fixed in position on the outside of an accelerator housing, with this unit including three, known-position, orthogonally-related datum surfaces that provide the datum foundations for defining the adjusted end position of the associated drift tube. Cooperating with this datum unit is a seating structure that is adapted for fixed-position joinder to a drift tube through the usual stem which supports the tube inside an accelerator. The seating structure includes three, complementing, orthogonally related datum surfaces designed for confrontational positioning, through fixed-dimension shim structure, with respect to the three datum surfaces in the datum unit.

Tightenable/relaxable anchoring mechanism drives the seating structure against the shim structure, along three orthogonal axes, and through such shim structure against the datum surfaces in the datum unit, thus to define forever, for all practical purposes, and so long as the shim structure remains unchanged, an accurate position for the associated drift tube. Obviously, because of the dimensional stability which characterizes the shim structure, it is comfortably possible to disassemble a drift tube from the housing, for reasons such as those mentioned earlier, with confidence, and strong assurance, that return to an anchored-in-position condition, utilizing exactly the same shim structure, will result in the drift tube being easily, properly repositioned. Quite apart of the disassembly/reassembly issue, the proposed shim-structure arrangement offers long-term stability not found in prior art drift tube linacs.

To deal with the issue raised above regarding adjustment for a post-coupler structure, the preferred embodiment of the present invention further includes special post-coupler adjustment mechanism which is removably, operatively attachable as desired to the externally accessible components of each post-coupler structure, with appropriate mechanism components provided that allow for ready angular and translational adjustment of each such post-coupler structure. Obviously this novel, nondedicated, attachable/removable approach significantly reduces the expense which would otherwise attend a conventional structure wherein each post-coupler structure has its own dedicated adjustment mechanism.

These and other objects, features and advantages which are offered by the invention will become more fully apparent as the description that now follows is read in conjunction with the accompanying drawings.

DETAILED DESCRIPTION, AND BEST MODE FOR CARRYING OUT, THE INVENTION

Figure 1:
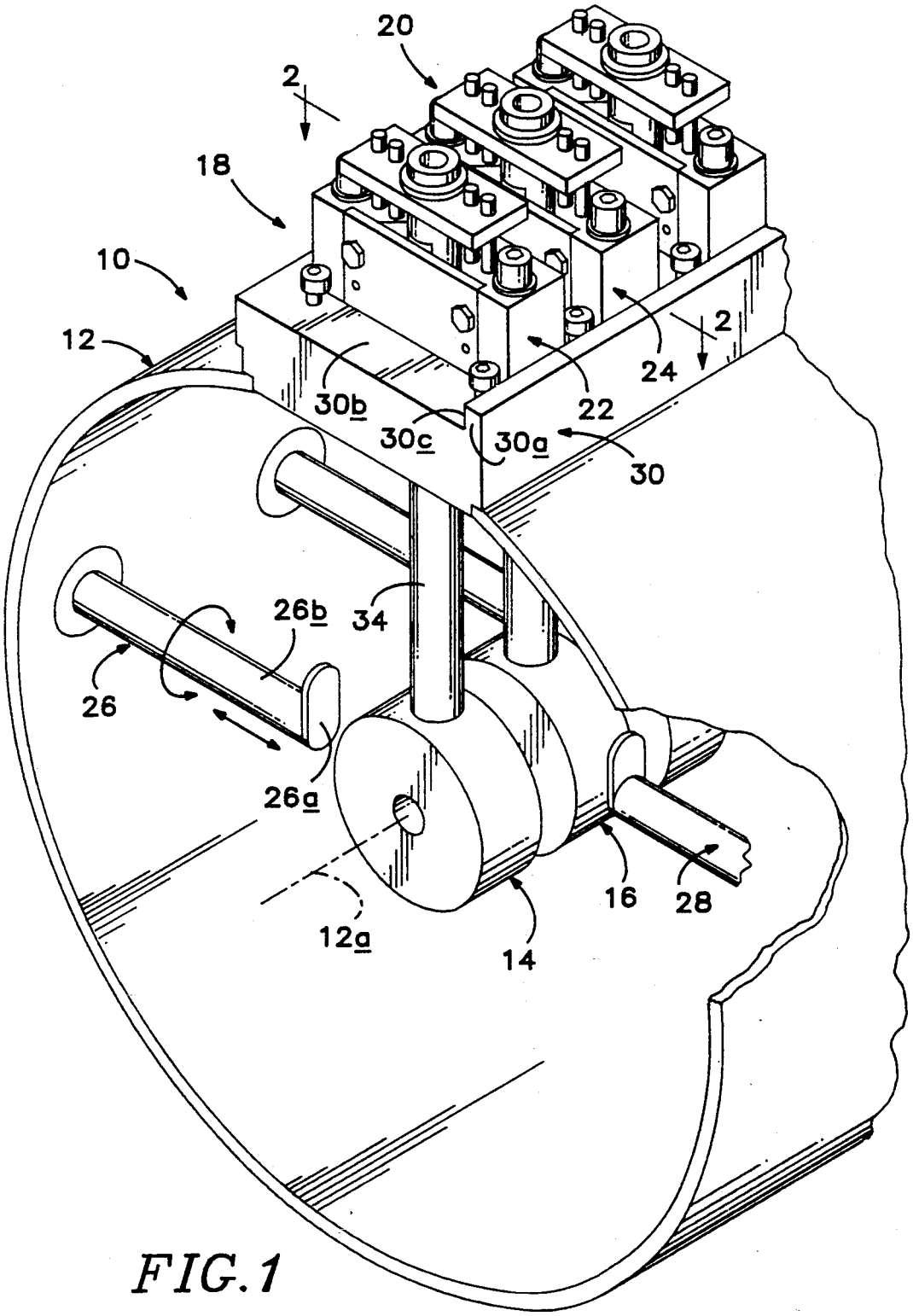
FIG. 1 is a fragmentary, perspective, opened-up view of a portion of a drift tube linear particle accelerator (linac) constructed in accordance with the present invention.

Turning attention now to the drawings, and referring first of all to FIG. 1, indicated generally at 10 is a drift tube linear particle accelerator (linac) which includes normalizing and performance maximizing apparatus constructed in accordance with the present invention. Except insofar as the constructional features of the present invention are concerned, accelerator 10 is in all other respects, as disclosed herein, entirely conventional in construction. Accelerator 10 includes the usual elongate, cylindrical housing 12, the central axis of symmetry of which, 12*a*, constitutes what is referred herein as the longitudinal operational axis of the accelerator.

Distributed along axis 12*a* are plural annular drift tubes, such as the two shown at 14, 16. The sizes and distributed positions of these drift tubes are determined in accordance with conventional practice, and accordingly, these features of accelerator 10 are not further detailed herein. With respect to positioning of the drift tubes, it is critical that each be located with a known precise position and angular orientation relative to axis 12*a*, and it is to address this important issue that certain features of the invention are provided. In general terms, joined as a unit to each of the drift tubes, such as to drift tubes 14, 16, is what is referred to herein as a datum-unit seating structure, such as structures 18, 20 shown generally for drift tubes 14, 16, respectively, which seating structures are, in the final assembly, anchored in place relative to complementary and corresponding datum units, such as units 22, 24 (better seen in figures still-to-be described) for structures 18, 20, respectively, which units occupy fixed positions on the outside of housing 12, generally at the locations shown in FIG. 1. As will be more fully explained, seating of the seating structures with their respective associated datum units is accomplished through dimensionally stable shim structure which is interposed pairs of confronting, complementary datum surfaces, still-to-be described, and tightened in place.

Provided for each of the drift tubes in accelerator 10 is post-coupler structure, such as the structures shown at 26, 28 for tubes 14, 16, respectively. Each post-coupler structure, such as structure 26 is substantially conventional in construction, and includes, inter alia, a coupler paddle or pad, such as pad 26*a*joined to an elongate cylindrical wand or stem, such as stem 26*b*. Station-by-station adjustment of the proximities and angular orientations of the pads, as indicated by the two double-ended arrows depicted adjacent stem 26*b*, is effective to make fine-tuning adjustments in the respective field configuration extant adjacent each drift tube. Other details of the conventional post-coupler structure will be discussed briefly in drawing figures still-to-be elaborated, as will be yet another important feature of the present invention—namely, the offering of attachable/detachable post-coupler adjustment mechanism which obviates the need for such a mechanism being dedicated to and for each of the post-coupler structures.

Figure 2:
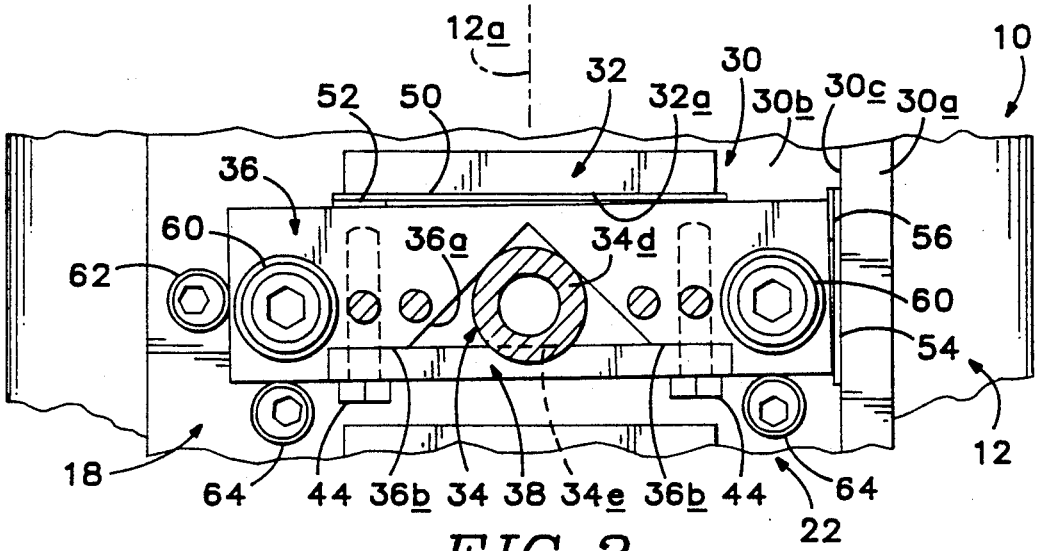
FIG. 2 is an enlarged, fragmentary, partially sectioned plan view illustrating one external mounting station provided for a drift tube in the linac of FIG. 1, with this view taken generally as indicated by line 2—2 in FIG. 1.
Figure 3:
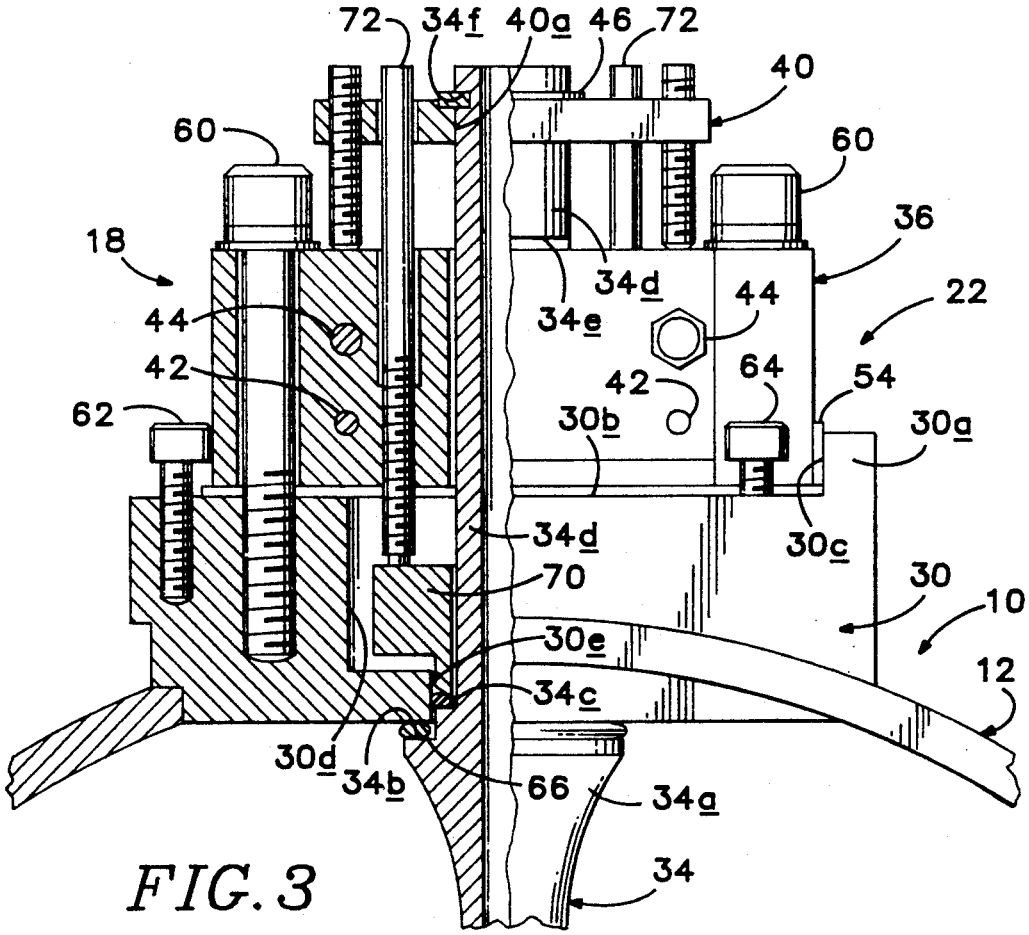
FIG. 3, which is on the same scale as FIG. 2, is taken from the bottom side thereof, with portions broken away, and with some in section, to illustrate details of construction.
Figure 4:
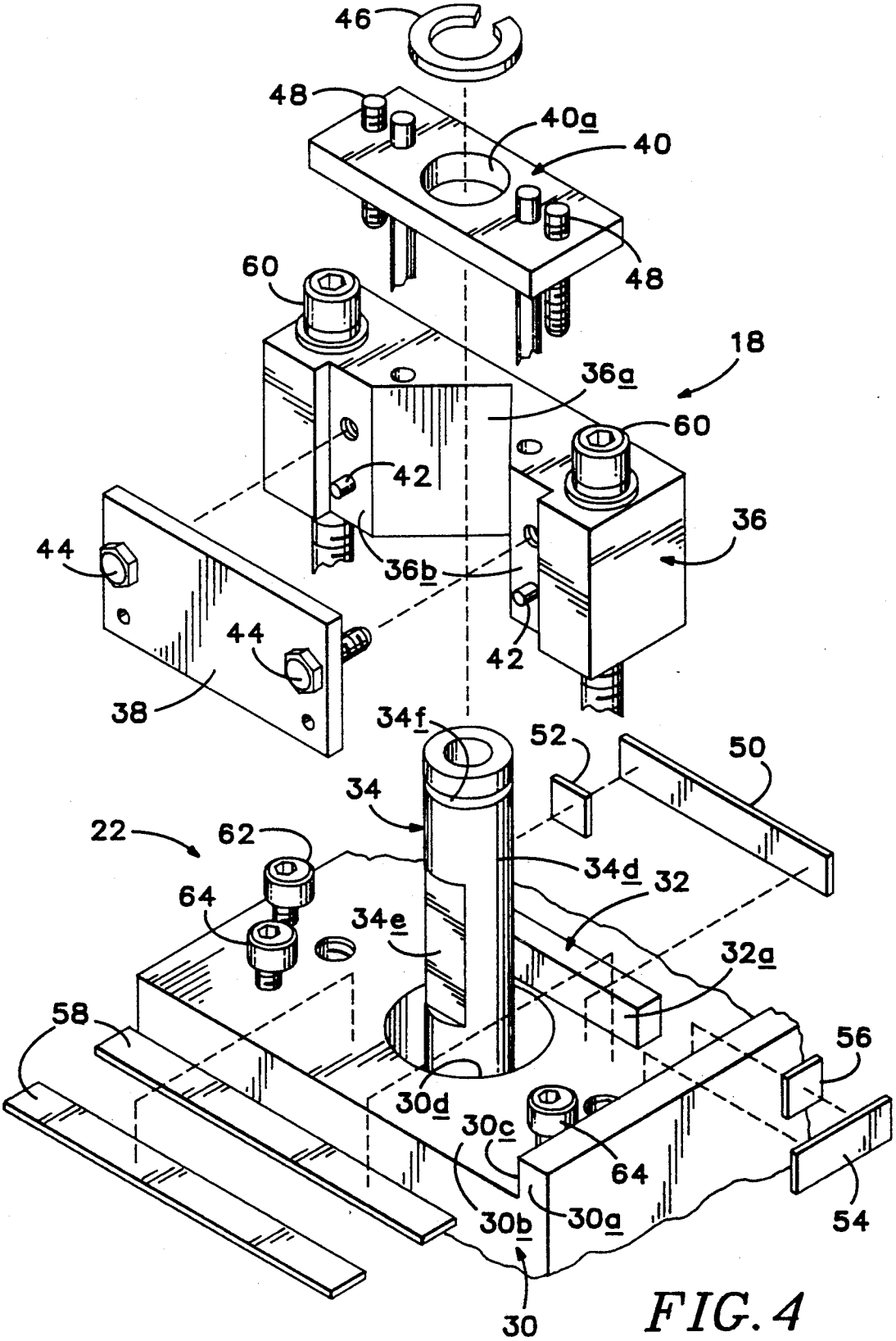
FIG. 4 is an exploded, perspective view, taken generally from the same-angle point of view as that taken in FIG. 1, illustrating the external mounting station which is detailed in FIGS. 2 and 3.

Continuing with a description of the structure and features of the invention, and referring now to FIGS. 2–4, inclusive, along with FIG. 1, joined as by welding to the top longitudinal part of housing 12 in accelerator 10 is an elongate spine member 30 which has the cross-sectional configuration that is generally illustrated in FIGS. 1 and 3. Member 30 includes an elongate, upwardly standing rib 30*a* which lies as shown along one side of the member. The spine member also includes an elongate, upwardly facing, planar surface 30*b* which substantially parallels axis 12*a*, and, disposed orthogonally with respect to this surface, another surface 30*c* (see particularly FIGS. 2 and 3) which is also substantially parallel to axis 12*a*, and which extends along that side of rib 30*a* which is closest to surface 30*b*.

Formed as by machining in the spine member at the location, or predefined station for location, of each of the drift tubes is an oversize clearance well, such as well 30*d* (see FIGS. 3 and 4), which is positioned in the spine member adjacent the location station provided for drift tube 14. At the base of well 30*d* is a throughbore 30*e* (See. FIG. 3). Similar wells and throughbores are provided at appropriate, known, distributed, spatially differentiated intervals along the length of the spine for the other drift tube location stations, all in accordance with dimensional considerations, mentioned earlier, well-known to those skilled in the art.

As will become apparent, spine member 30 is, in the embodiment now being described, a member shared throughout the apparatus of the invention, portions of which member, adjacent each "station", form part of what has been referred to herein as a datum unit associated with each drift tube in the accelerator. The portions of surfaces 30*b*, 30*c* which are adjacent the different respective location stations form part of what is referred to herein as datum-surface structure, and individually, adjacent each drift tube location station, constitute portions of an overall plurality of datum surfaces. The spine member and its surfaces 30b, 30c are prepared with the closest attainable tolerances to have, as accurately as possible, a precise predefined relationship to axis 12a.

Formed as by machining to rise above surface 30b at locations distributed therealong associated with each drift tube positioning station, and to one side of the wells, such as well 30d, are elongate crossbars, such as crossbar 32 (shown particularly in FIGS. 2 and 4). Each crossbar includes a surface, such as surface 32a, which faces its respective associated "well", which surface is, as precisely as is possible, disposed orthogonally with respect both to surface 30b and to surface 30a. The crossbars cooperate with the spine member to form, collectively, the entirety of what has been referred to hereinabove as a datum unit; the surfaces, such as surface 32a, at the location of each drift tube "station" form part of the overall organization referred to as datum-surface structure, and each of these very same surfaces is referred to individually as a datum surface. In the vicinity of well 30d and crossbar 32, this cooperative structure forms previously mentioned datum unit 22 for association with drift tube 14.

As will shortly be explained, it is relative to the datum surfaces that have just been described at the location of each drift tube station that, through shim structure still-to-be described, an associated drift tube is precision-located relative to axis 12a and removably anchored in position. In this regard, one matter to note at this point in the discussion is that, obviously, the datum unit structure, and its associated datum surfaces, offer a high degree of predictable, substantially unchangeable dimensional and positional stability. As will become apparent, these datum surfaces are located so that "some" orthogonal shimming will necessarily be required for positioning a drift tube. This "negative tolerance" condition assures that, under all circumstances, the assembler, technician, etc. can assuredly achieve proper drift tube final positioning.

Describing now the components of the datum-unit seating structures, and doing this particularly with reference to structure 18 which is provided for drift tube 14, joined to the outer circumference of, and extending upwardly, radially from drift tube 14, is an elongate stem 34 which includes an outwardly flaring enlarged portion 34a (see FIG. 3), the upper region of which defines a pair of vertically, axially offset shoulders 34b, 34c (also seen in FIG. 3) and which joins with an upper extension 34d that has, relative to enlarged portion 34a, a reduced, uniform-diameter dimension which is substantially the same as that characterizing the diametral dimension of the part of the stem which extends below portion 34a. As can be seen illustrated in FIGS. 2 and 4, upper extension 34d includes a generally rectilinear relief 34e which has an obvious, outwardly facing, planar, upright surface that faces downwardly in FIG. 2, and downwardly and to the left in FIG. 4, which relief terminates vertically with outwardly extending, relatively orthogonally disposed, upper and lower ledges or shoulders. Extending circumferentially about the outside of upper extension 34d is an annular groove 34f (see FIGS. 3 and 4).

Removably and snugly joined to upper extension 34d, and also forming part of datum-unit seating structure 18, is a cooperating trio of components including a block 36, a plate 38 and a cap 40.

Block 36 has the outer rectilinear topography which is clearly illustrated in FIGS. 2, 3 and 4, and includes a right-angle receiving wedge 36a which opens to a relief 36b that faces downwardly in FIG. 2, toward the viewer in FIG. 3, and downwardly and toward the left in FIG. 4.

Upper extension 34d in stem 34 is received in wedge 36a as shown, and is clamped therein by plate 38 which is seated in relief 36b, located therein by locating pins 42, and held in place by bolts 44. The central portion of plate 38 is received in, and clamps against, relief 34e, and a vertical position for the assemblage of block 36 and plate 38 is established, as will now be explained, by means of cap 40 and certain interposing structure. More specifically, cap 40 includes a central throughbore 40a (see FIGS. 3 and 4) which freely receives the upper extremity of stem 34, with the upper portion of this throughbore including an enlarged and stepped dimension, as can be seen in FIGS. 3 and 4, into which seats a positioning split-ring 46 that also fits within previously mentioned groove 34f in stem upper extension 34d. Threaded rods 48 are screwed through suitable threaded accommodating bores provided adjacent the opposite lateral extremities of cap 40, and are driven downwardly against the upper surface of block 36 thus to seat the underside of plate 38 firmly against the lower ledge or shoulder which defines the lower extremity of relief 34e.

In seating structure 18, the back side of block 36, i.e., that side which is angled toward the right and away from the viewer in FIG. 4, on the upper side of the block in FIG. 2, and hidden away from the viewer in FIG. 3, forms one datum surface in structure 18. The lateral end of block 36 which is visible to the viewer on the right side of FIG. 4, and which is toward the right sides of the block in both FIGS. 2 and 3, forms another datum surface. Finally, the underside of block 36 forms a third datum surface which cooperates with the other two just mentioned to form what is referred to herein collectively as datum-surface-complementing structure. These three datum surfaces are prepared as accurately as possible by machining to have a true orthogonal relationship relative to one another. They are also prepared so that were they to seat directly, i.e., without shimming, against their respective associated "datum-unit datum surfaces", the associated drift tube would be "negatively" positioned relative to its desired final axial position within the accelerator.

According to one significant feature of the present invention, the drift tube/stem/datum-unit seating structure assemblage which has just been described is anchored removably in place in accelerator 10 through and against shim structure which is interposed the datum-surfaces provided in and by datum unit 22, and those, just mentioned, provided in seating structure 18.

At the time that each drift tube and its associated seating structure is mounted in place within the accelerator, the installer carefully selects appropriate shim structure for interposition between complementary datum surfaces in order to assure proper positional (translational and rotational) orientation of the associated drift tube relative to axis 12a. By using single-thickness shim structure interposed each pair of complementing/confronting datum surfaces, the translational positional relationship of the associated drift tube can be established. Uniform thickness can, of course, be achieved either through the use of single-thickness shim stock, or layered shim stock. Rotational orientation can be established by using, for example, shim stock whose thickness is differentiated across the interface between two confronting datum surfaces, and this is most easily accomplished by using a layered structure with a relatively short piece of shim stock employed toward what might be thought of as the open end of the angular relationship which is created.

Referring to FIGS. 2, 3 and 4, interposed surface 32*a* and the back surface of block 36 are two shims 50, 52. Shim 50, which is uniform in thickness across its length, extends completely laterally across these confronting surfaces, and shim 52, which is relatively stubby in length, and also uniform in thickness, is disposed between the surfaces on what is the underside of shim 50 in FIG. 2, thus to augment translational positioning effected by shim 50 with slight counter-clockwise angular rotational positioning for associated drift tube 14.

Interposed the right side of block 36 in FIG. 2 and surface 30*c* is a similar shimming arrangement including shims 54, 56. Shim 54, which provides a basic to-the-left (in FIG. 2) translational adjustment for drift tube 14, extends substantially entirely across the interface now being discussed, and shim 56, like previously mentioned shim 52, is stubby in length and cooperates in the counter-clockwise rotational angulation previously mentioned.

Interposed the underside of block 36 and surface 30*b* (see particularly FIGS. 3 and 4), are two, matching, laterally spaced, single-thickness shims 58 which contribute a slight vertical positioning adjustment for associated drift tube 14.

Other specific shimming arrangements may, of course, be used.

Once an appropriate shimming organization has been established to assure proper translational and angular positioning of drift tube 14 relative to axis 12*a*, dimensional stability of the shim structure assures positional stability under all circumstances for this drift tube. And, if it later becomes necessary to remove the drift tube for any reason, subsequent replacement of the pre-selected positioning shims assures return of the drift tube to a proper disposition.

With all of the shims in position, everything is anchored in place by means of what is referred to herein as anchor structure which includes, inter alia, bolts 60 which drive block 36 downwardly toward spine member 30, a cam bolt 62 which drives block 36 toward surface 30*c*, and a pair of laterally spaced cam bolts 64 which drive block 36 toward surface 32*a*.

With all of the components in the positions illustrated for them in FIG. 3, radio-frequency sealing and vacuum sealing are accomplished conventionally. Thus, a radio-frequency seal is shown at 66 suitably clamped between the underside of spine member 30 and the lower ledge formed in stem flaring portion 34*a*. A vacuum seal 68 is clamped in place against the upper ledge in this flaring portion by a conventional driver 70 which is urged into position through actuation of a pair of threaded rods 72, each of which extends through a suitable threaded accommodating bore provided adjacent the base of block 36, with the upper extremity of each such rod extending through aligned clearance bores provided both in the upper portion of block 36 and through previously mentioned cap 40.

Figure 5:
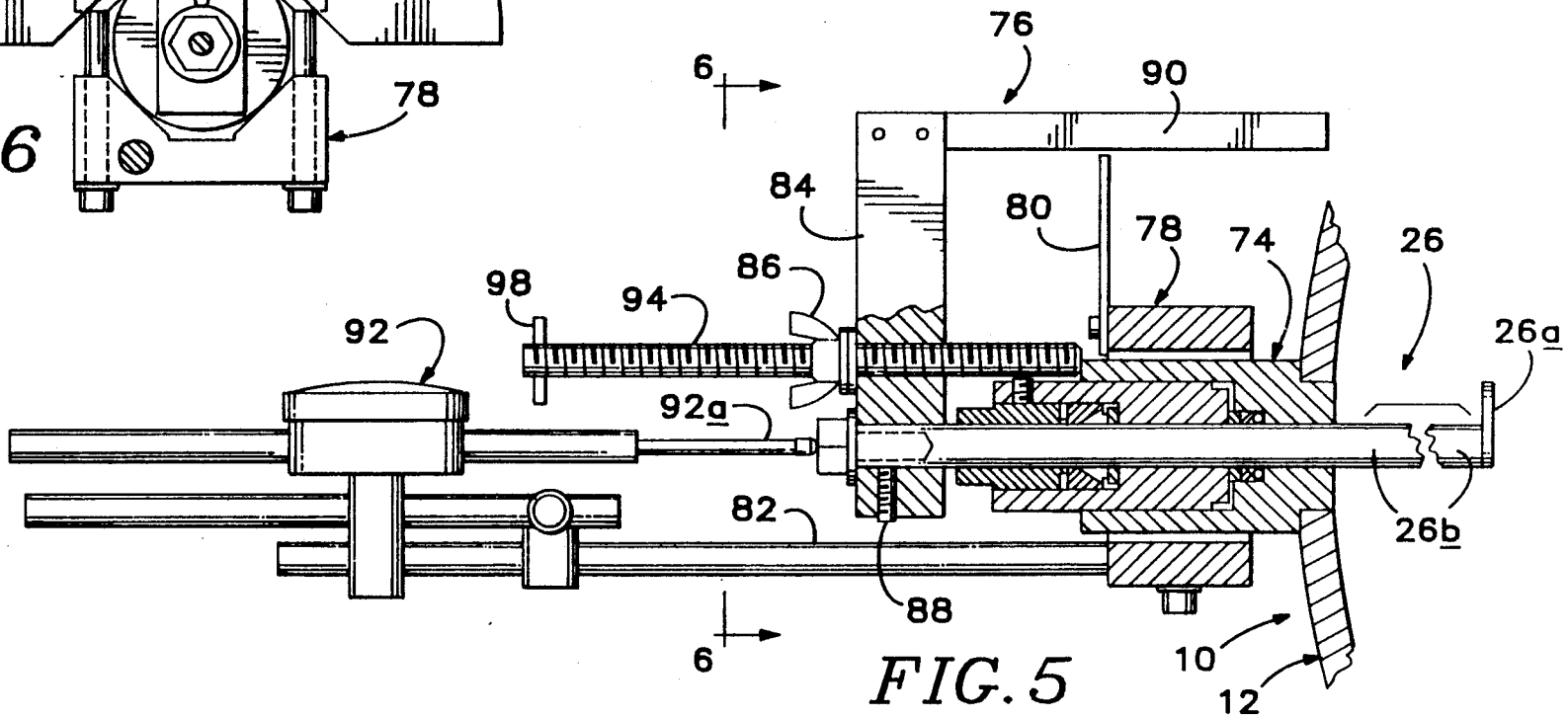
FIG. 5 is an axial-point-of-view, fragmentary and partially sectioned drawing, on a scale slightly smaller than that used in FIGS. 2 and 3, showing details of post-coupler structure, and of post-coupler adjustment mechanism—the latter being constructed in accordance with the present invention.
Figure 6:
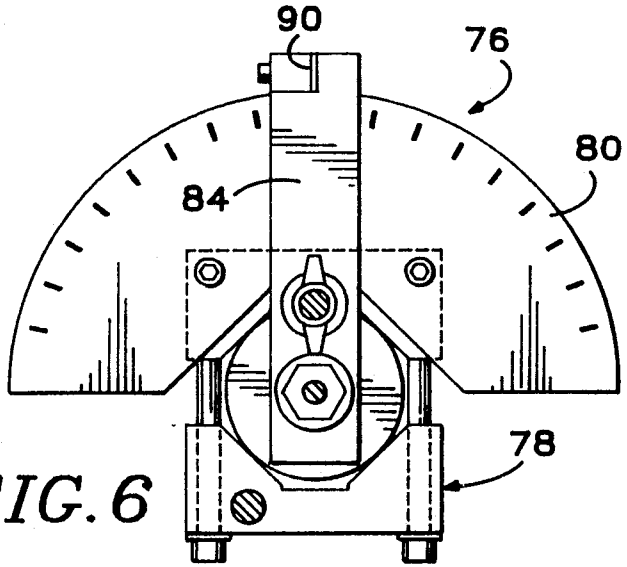
FIG. 6 is a view taken generally along line 6—6 in FIG. 5.
Figure 7:
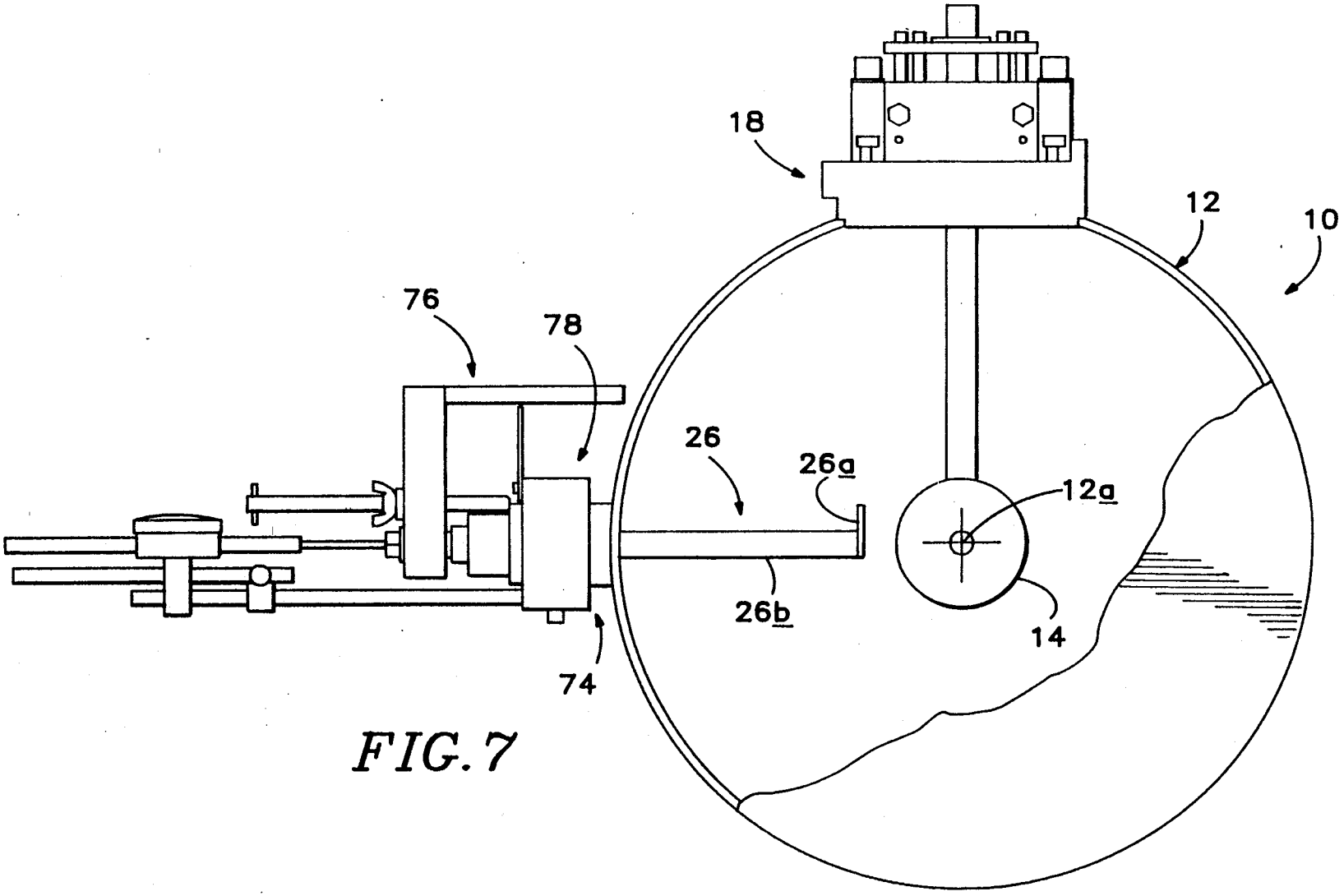
FIG. 7 is a block/schematic end view of the linac of FIG. 1 illustrating, relative to the linac's long axis, the angular positional relationship of a mounting station and of a post-coupler structure to which is attached an adjustment mechanism.

Turning attention now to FIGS. 5, 6 and 7, previously referred to post-coupler structure 26 is shown, partly in section, (see FIG. 5) where it is mounted on housing 12. Without going into great detail about the construction of the post-coupler structure, since the same is substantially, entirely conventional in construction, suffice-it-to-say that stem 26*b* extends radially outwardly of housing 12 through radio-frequency and vacuum sealing and tightening structure 74. In prior art linacs, it is conventional to provide, on a dedicated, always fixed-installed in place, basis, for each post-coupler structure for each drift tube, an associated adjustment mechanism which allows for translational and rotational adjustment of paddles, such as paddle 26*a*, for each drift tube. Obviously, such is a costly arrangement. According to the present invention, provided for accomplishing this very same adjustment function is a removably mountable adjustment mechanism which is not dedicated to any one post-coupler structure. Such a mechanism is shown at 76 in place for adjustment with respect to post-coupler structure 26 in FIGS. 5, 6 and 7.

Describing, now, mechanism 76, the same includes a clamp/mounting structure 78 which is bolt-clamped onto a collar that forms one of the conventional outer accessible members in structure 26. Mounting structure 78, once clamped in place, does not move during an adjustment procedure. This mounting structure carries an angle indicator dial 80 as shown, and an elongate frame rod 82 that extends outwardly of housing 12 beneath and generally parallel to stem 26*b*.

Further included in mechanism 76 is an arm 84 which is removably anchored to the outer end of stem 26*b* by way of a bolt 86, which bolt is screwed into the receiving outer end of stem 26*b*, and a set screw 88 which is tightened into a prepared groove (not shown) exposed on the outer circumference of the outer end of stem 26*b*. Arm 84 is thus anchored for movement as a unit with the stem. The upper end of arm 84 carries an elongate pointer finger 90 whose position is readable relative to angular indicia markings provided on that face of dial 80 which faces the viewer in FIG. 6.

Suitably mounted on rod 82 is a conventional dial indicator 92 whose sense-arm 92*a* contacts the head of the bolt that attaches arm 84 to the outer end of stem 26*b*.

Finally, threadedly extending through a suitable threaded accommodating bore between the ends of arm 84 is a threaded rod 94. Rod 94 can be releasably tightened in place relative to the arm by a wing nut 86, and axially adjusted relative to the arm, when released by nut 86, by manipulation of a turn handle 98.

With mechanism 76 in place, and with structure 74 in a relaxed condition, vis-a-vis allowing movement of stem 26*b*, the axial (translational) position of the post-coupler structure stem and paddle is adjusted largely through manipulation of rod 94 and handle 98. The translational position, once established, can be locked against further adjustment through the use of wing nut 96. Monitoring of this activity, of course, occurs through reading of indicator 92.

Rotational adjustment of the post-coupler structure takes place through rotation of arm 84 which, as will be remembered, is anchored for movement as a unit with stem 26*b*. Angular adjustment readings occur through correlation between indicia on dial 80 and the position of finger 90.

Typically, an overall post-coupler adjustment procedure is accomplished with an adjustment mechanism, like that just described, attached, all at one time, to each of the post-coupler structures. When all adjustments are complete, the adjustment mechanisms are unfastened from the outer ends of the stem and unclamped from the remainder of the external support structures for the post-coupler structures.

Thus there has been disclosed and described herein novel apparatus for normalizing and maximizing the performance of a drift tube on and along the longitudinal operational axis in a drift tube linear particle accelerator. Predictable and reliable dimensional stability is accomplished through positional adjustment structure that features dimensionally stable shims that are interposed and clamped between facially confronting, complementary, orthogonally disposed datum surfaces which are located on the outside of the housing in such an accelerator. What might be thought of as "final" electromagnetic normalizing and positioning is accomplished through non-dedicated, attachable/removable adjustment mechanism which is employed at the location of each conventional post-coupler structure to effect translational and rotational adjustment of the same. The apparatus of the invention, in addition, features simplicity in construction and significant cost reduction when compared with its prior art counterparts. In addition to all of this, the apparatus of the invention is extremely simple to use.

It is desired to claim and secure by Letters Patent:

1. An apparatus for normalizing and maximizing the performance of a drift tube along a longitudinal, operational axis of an elongate housing in a drift tube linear particle accelerator, said apparatus comprising a datum unit fixed-positionally-associated with the axis and anchored to the housing, said unit including orthogonally-related datum-surface structure, datum-unit seating structure fixed-positionally-joinable to the drift tube and including orthogonally-related datum-surface-complementing structure adapted to confront complementarily said datum-surface structure, shim structure operatively and selectively placeable between said datum-surface and said datum-surface-complementing structure to establish a fixed, complementary, relative positional relationship between the two, and anchor mechanism which is selectively tightenable and relaxable operatively placeable between said datum unit and said datum-unit seating structure, said anchor mechanism being operable, with said shim structure placed between said datum-surface structure and said datum-surface-complementing structure, for anchoring a drift tube which is joined to said seating structure in a position optimized and normalized with respect to the mentioned axis.

2. The apparatus of claim 1 which further is for use in conjunction with an accelerator of the type mentioned that includes externally accessible, adjustable post-coupler structure operatively interposed the drift tube and the housing, and wherein said apparatus further includes, for the post-coupler structure, removably, operatively attachable post-coupler adjustment mechanism operable, when attached externally of the housing to the post-coupler structure, to accommodate selective adjustment of the post-coupler structure.

3. The apparatus of claim 2, wherein said adjustment mechanism includes both means for producing translational adjustment, and means for producing rotational adjustment, of the post-coupler structure.

4. The apparatus of claims 1, 2 or 3, wherein each of said datum-surface structure and said datum-surface-complementing structure includes three, orthogonally-related datum surfaces.

5. An apparatus for normalizing and maximizing the performance of a drift tube along a longitudinal, operational axis of an elongate housing in a drift tube linear particle accelerator, with the drift tube positioned on and along the mentioned axis, and with the accelerator including externally accessible, adjustable post-coupler structure operatively interposed the drift tube and the housing, said apparatus comprising mounting structure removably and operatively attachable externally of the housing to the post-coupler structure, and adjustment means carried on said mounting structure, and operatively coupleable with the post-coupler structure under circumstances with said mounting structure operatively attached to the post-coupler structure, to accommodate selective adjustment of the post-coupler structure.

6. The apparatus of claim 5, wherein said adjustment means includes both means for producing translational adjustment, and means for producing rotational adjustment, of the post-coupler structure.

7. An apparatus for normalizing and maximizing the performance of a drift tube along a longitudinal, operational axis of an elongate housing in a drift tube linear particle accelerator, where the accelerator includes externally accessible, adjustable post-coupler structure carried on the housing and operatively interposable therebetween and a drift tube mounted along the axis of the housing, said apparatus comprising a datum unit fixed-positionally-associated with the mentioned axis and anchored to the housing, said unit including orthogonally-related datum-surface structure, datum-unit seating structure fixed-positionally-joinable to the drift tube and including orthogonally-related datum-surface-complementing structure adapted to confront complementarily said datum-surface structure, shim structure operatively and selectively placeable between said datum-surface structure and said datum-surface-complementing structure to establish a fixed, complementary relationship between the two, anchor mechanism which is selectively tightenable and relaxable operatively placeable between said datum unit and said datum-unit seating structure, said anchor mechanism being operable, with said shim structure placed between said datum-surface structure and said datum-surface-complementing structure, for anchoring a drift tube which is joined to said seating structure in a position optimized and normalized with respect to the mentioned axis, and for the post-coupler structure, removably, operatively attachable post-coupler adjustment mechanism, operable, when attached externally of the housing to the post-coupler structure, to accommodate selective adjustment of the post-coupler structure positionally relative to a drift tube disposed along the mentioned axis.

* * * * *

UNITED STATES PATENT AND TRADEMARK OFFICE

CERTIFICATE OF CORRECTION

PATENT NO. : 5,179,350

DATED : January 12, 1993

INVENTOR(S) : John H. Bower, James M. Potter and Joseph P. Rymer

It is certified that error appears in the above-identified patent and that said Letters Patent is hereby corrected as shown below:

In column 1, line 5, please insert --This invention was made with Government support under grant number 5R44CA43915-02 awarded by the National Institutes of Health. The Government has certain rights in this invention.--

Signed and Sealed this

Seventh Day of November, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,179,350

DATED : January 12, 1993

INVENTOR(S) : John H. Bower, James M. Potter and Joseph P. Rymer

It is certified that error appears in the above-identified patent and that said Letters Patent is hereby corrected as shown below:

On the title page, item [75], please correct "Inventors" to read as follows: --John H. Bower, Livermore; James M. Potter, Los Alamos; Joseph P. Rymer, Livermore, all of California--

Signed and Sealed this

Twenty-third Day of January, 1996

*Attest:*

Bruce Lehman

BRUCE LEHMAN

*Attesting Officer*

*Commissioner of Patents and Trademarks*